United States Patent [19]

Pfarrwaller

[11] 3,951,179

[45] Apr. 20, 1976

[54] DEVICE FOR SEVERING A THREAD IN A TEXTILE MACHINE

[75] Inventor: Erwin Pfarrwaller, Winterthur, Switzerland

[73] Assignee: Sulzer Brothers Limited, Winterthur, Switzerland

[22] Filed: Oct. 29, 1974

[21] Appl. No.: 518,982

[30] Foreign Application Priority Data

Nov. 2, 1973 Switzerland ..... 15421/73

[52] U.S. Cl. ..... 139/302; 139/263; 28/1 CS

[51] Int. Cl.[2] ..... D03D 47/36; D03D 45/50

[58] Field of Search ..... 139/302, 303, 263–267, 139/126, 127 R; 28/1 CS, 72 CS, 64, 71.4; 83/557, 909

[56] References Cited

UNITED STATES PATENTS

| | | | |
|---|---|---|---|
| 1,157,397 | 10/1915 | Imbach | 139/263 |
| 1,393,539 | 10/1921 | Jourdain | 139/263 |
| 1,899,634 | 2/1933 | Payne | 139/263 |
| 2,052,655 | 9/1936 | Poul | 139/126 |
| 2,420,380 | 5/1947 | Moessinger | 139/126 |
| 2,578,205 | 12/1951 | Pfarrwaller | 139/126 |
| 3,310,073 | 3/1967 | Claeys | 139/126 X |

FOREIGN PATENTS OR APPLICATIONS

| | | | |
|---|---|---|---|
| 503,909 | 3/1920 | France | 139/263 |
| 1,158,031 | 6/1969 | United Kingdom | 139/126 |

*Primary Examiner*—James Kee Chi
*Attorney, Agent, or Firm*—Kenyon & Kenyon Reilly Carr & Chapin

[57] ABSTRACT

The anvil element and severing element are mounted so that the cutting edge or the thread supporting surface or both can adjust to the other during a severing operation. To this end, one or the other or both elements are pivotally mounted on their respective levers. In addition, a power storage means in the form of a spring or compressed air tank is connected to one or the other or both elements to absorb the force of impact of the severing element on the anvil element.

19 Claims, 6 Drawing Figures

48
49
46'
47
45
46
44
4
3
52
53'
53
51
A
III
20
20'
13
29'
32
1'
31
28
32
B
19
22
18
20
2
26
29a
32
25
17
14
1
29
32
27
7
5
7b
8b
8
8a
7a
7'
37'
8'
38'
42
36
39
43
37
38
36
40
41
35
9
12
6
III

DEVICE FOR SEVERING A THREAD IN A TEXTILE MACHINE

This invention relates to a device for severing a thread in a textile machine and particularly in a loom in which a weft thread is supplied from outside a shed.

Heretofore, various types of thread severing devices have been known which employ an anvil element with a surface to support the thread to be severed and a chisel-like severing element with a cutting edge which can be brought against the thread-supporting surface to sever the thread. In such severing devices, the severing element is usually in the region of a spreader of a loom which is disposed on an armature lever of an electromagnet and which becomes set into operation intermittently by a senser moved over a thread end to be severed. In this way, the severing element which is similar to the clapper of an electric bell, is set oscillating so as to sever a weft-thread end projecting laterally from the edge of the fabric.

One advantage of these known severing devices resides in the avoidance of wear of the cooperating parts, such as for example occurs with scissors-like severing devices, as caused by the frictional forces occurring during the shearing movement. However, the cutting edge of the severing element and/or the supporting surface of the anvil element can become damaged if the two elements, perhaps due to faulty adjustment or because of unequal wear, do not encounter one another with lineal contact.

The elimination of damage to severing devices, particularly in the case of high-speed machines such as looms having over 200 insertions of the weft and severing operations each minute, causes a relatively large expenditure for replacement parts and servicing. In addition, frequent stoppage of the machine is required in order to repair or replace the severing devices.

Accordingly, it is an object of the invention to provide a severing device for threads which operates with little wear.

It is another object of the invention to reduce the downtime of a loom caused by faulty thread severing devices.

It is another object of the invention to provide a simple reliable thread severing device for use in cutting weft threads in a loom.

Briefly, the invention provides a thread severing device which has an anvil element with a thread supporting surface and a chisel-like severing element having a cutting edge for abutting against the supporting surface of the anvil element to sever a thread. In addition, the device includes a means which supports the anvil and severing elements for relative motion towards each other to bring the cutting edge against the anvil surface. At least one of the elements is adjustably mounted, for example pivotally, on the support means so that at least one of the cutting edge and supporting surface is adjustable relative to the other. The severing device also has a power storage means connected to at least one of the elements to absorb a force of impact of the cutting edge on the anvil supporting surface.

The invention allows not only the constructional parts of the severing device but also of the contrivances of the machine cooperating with the severing device to be subjected to particularly favorable stresses.

The operation of the severing device is derived from the machine drive so that the two cooperating elements of the device are in contact with one another during a preset interval of time which includes the severing operation. Severance of the thread is ensured by the power-storer at each meeting of the severing elements. Thus, in accordance with the prevailing operating conditions, an optimum position of the cooperating elements can be preselected, or become automatically set.

In order to obtain satisfactory bearing against one another of the encountering elements, preferably the adjustable and/or the fixable parts, i.e. the severing element and/or the anvil-element, is pivotably mounted on an axis running substantially parallel to the direction in which the thread to be severed runs.

In one embodiment, a clamp is disposed on the support means to ensure the operative position of the elements. This clamp can be locked in position relative to the severing element or the anvil element. In this way, the element concerned can adjust itself relative to the other element, but is held elastically in the position reached without impairment of its adjustability.

One particular reliable and exactly operable severing device, particularly for a controlled setting-on of the movable severing element, has the support means cooperate with a driving and/or operating element acting counter to the power-storage means over a guideway formed on the support means. The cooperation is such that the operating element, for example a cam, is released from the range of movement of the support means in a predetermined operational position of the support means which is reached substantially at the encountering with one another of the severing element and the anvil-element. For example, the cam becomes spaced from the guideway so that the support means is released.

In order to increase reliability and simplify maintenance work on the severing device, the chisel-like severing element has at least two cutting edges, which can be brought as desired into the operative position. Correspondingly, the anvil element has at least two supporting surfaces which can be brought selectively into the operative position.

In order to obtain particularly accurate guidance of the thread which is to be severed, prior to and during the severing operation, the anvil-element can be provided with two guideways or guide teeth on both sides of the path of the thread and projecting above the supporting surface. In this way the thread is held exactly at the desired place and is presented for severance. Preferably, the guide teeth have flanks turned toward the path of the thread which form an obtuse angle with the supporting surface.

These and other objects and advantages of the invention will become more apparent from the following detailed description and appended claims taken in conjunction with the accompanying drawings in which:

FIGS. 1 and 2 each illustrate a severing device in accordance with the invention in different operative positions;

Referring to FIGS. 1 to 4, the severing device is installed in a loom (not shown) in which a weft thread 1 is drawn off a supply spool positioned outside the loom-shed and inserted by a shuttle (gripper-shuttle) 2 into the loom-shed. After each insertion, e.g. at more than 200 times per minute, the thread is severed.

Figure 1:
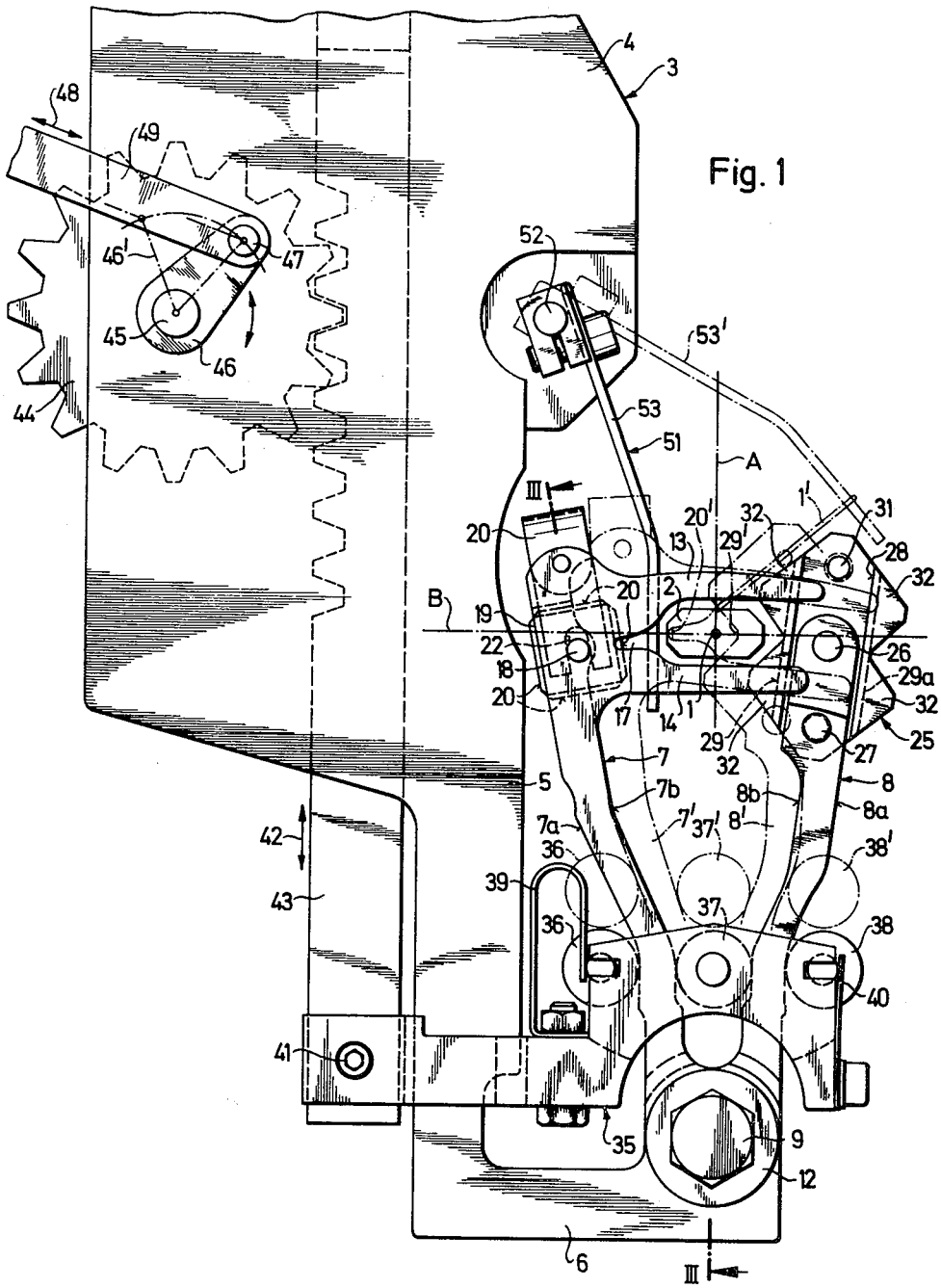
Figure 2:
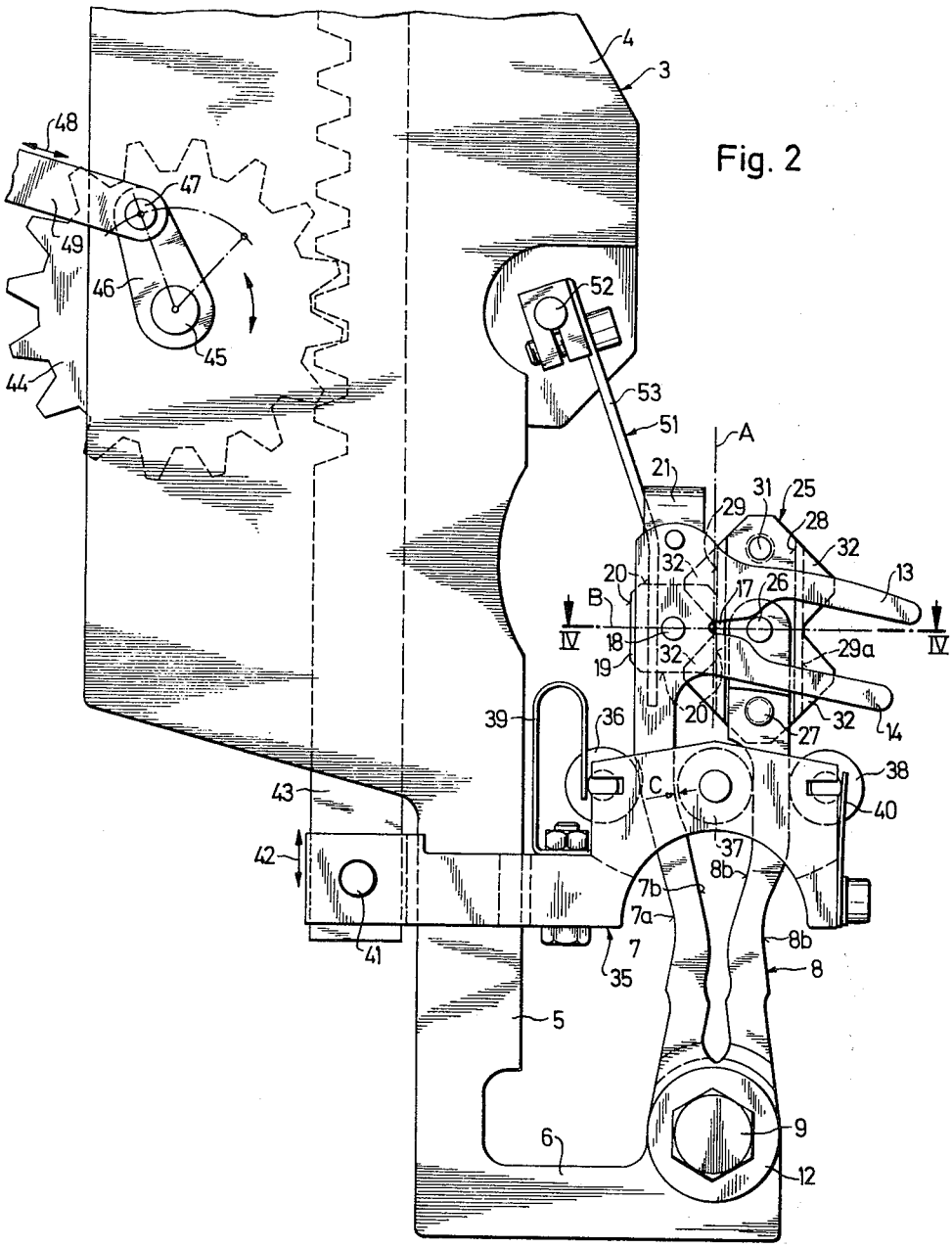
Figure 3:
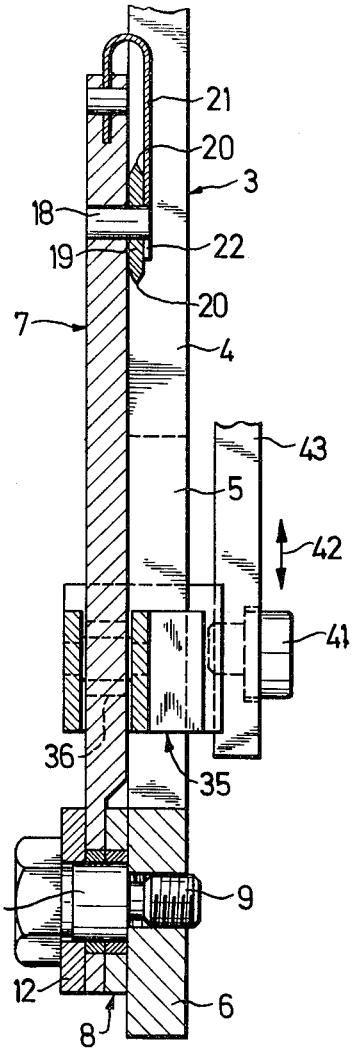
FIG. 3 illustrates a view taken along line III—III of FIG. 1.

The severing device is disposed on a support means such as a holder 3 which is fastened to a carrying part (not shown) of the loom frame. The holder 3 is made substantially of a plate 4 with a prolonged vertical guide-arm 5 from which a horizontal arm 6 projects kneewise. The arm 6 has two levers 7, 8 pivotally mounted thereon by means of a screw 9. As shown in FIG. 3, the screw 9 is threaded into the arm 6 and carries a collar 11 about which the levers 7, 8 pivot. A washer 12 is also provided between the screw head and the outer lever 7. As shown in FIGS. 1 and 2, the levers 7, 8 are able to move between an open operative position (FIG. 1) and a severing position (FIG. 2).

Referring to FIG. 1, the lever 7 has a pair of integral beak-like arms 13, 14 at the free end which are disposed on opposite sides of the path of the shuttle 2. The facing flanks of the arms 13, 14 approach each other at the inner ends to form a substantially V-shaped recess 17 for receiving and guiding the thread 1 when the lever 7 is moved to the severing position (FIG. 2). The lever 7 also carries a pin 18 in a fixed manner near the free end which, in turn, mounts a chisel-like severing element 19. The element 19 is mounted on the pin 18 so as to be freely rotatable. The severing element 19 is formed as a generally rectangular plate with cutting edges 20 each of which projects into the recess 17 when the element 19 is in operative position. A holding means in the form of a looped spring 21 is mounted on the lever 7 for securing the severing element 19 to the lever 7 in one of a plurality of positions under a variable elastic force. The spring 21 is biased against the severing element 19 (FIG. 3) and has a cut-out 22 on the free end to pass around the pin 18.

Figure 4:
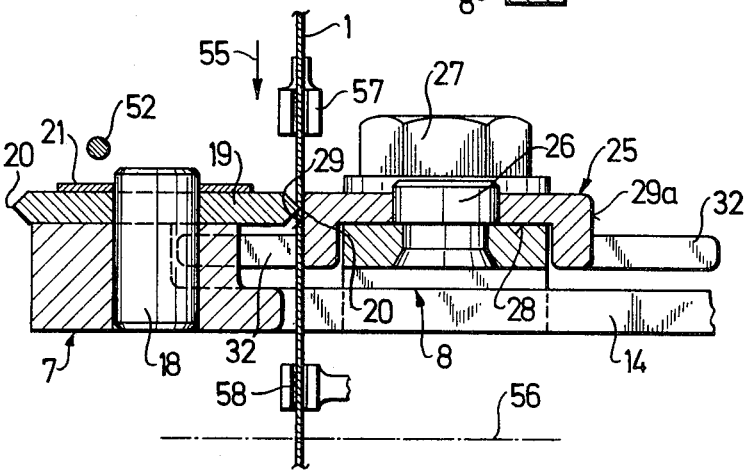
FIG. 4 illustrates a view taken along line IV—IV of FIG. 2 to an enlarged scale.

The lever 8 has a pin 26 fixed at the free end which carries an anvil element 25. As shown in FIG. 4, the anvil element is secured to the lever 8 by a screw 27 and has a profile with a recess 28 to receive the lever 8. In addition, the anvil element 25 has a pair of supporting surfaces 29, 29*a* on opposite sides which can be selectively brought into operative position, i.e. facing the severing element 19. Each of the supporting surfaces 29, 29*a*, when positioned, cooperates with a cutting edge 20 of the severing element 19. With the illustrated example, the anvil surface 29 is in the operative position. In order to change the anvil surface, the anvil element 25 is turned 180° around the pin 26 until the anvil surface 29*a* is in the operative position. Thereafter, the screw 27 is passed through a hole 31 in the element 25 and threaded into the lever 8.

The anvil element 25 is provided at both sides with two guide-teeth 32 which project over the anvil surface 29 or 29*a*. Each pair of teeth 32 has facing flanks which form an obtuse angle with the corresponding anvil surface 29 or 29*a* to form an approximately V-shaped guide for the thread 1.

As shown in FIG. 1, the arms of the levers 7, 8 pass between cam rollers 36, 37, 38 mounted on a support 35. These cam rollers 36, 37, 38 cooperate with the side of the levers 7, 8, which, for this purpose, are formed as cam surfaces 7*a*, 7*b* and 8*a*, 8*b*. The axles of the two outer rolls 36, 38 are mounted in the support 35 to be displaced transversely of the levers 7, 8, and each is tensioned against the associated lever 7, 8 respectively by a power storage means such as a spring 39, 40, respectively, fastened to the support 35. The spring 39 for the lever 7 carrying the severing element 19 is made particularly strong.

The support 35 is displaceably mounted on the guide arms 5 and is fastened by a screw to a toothed rack 43 which is able to move in the direction indicated by the arrow 42 in engagement with a gearwheel 44. The gearwheel 44 is mounted on a shaft 45 installed in the plate 4 to which shaft 45 is fastened a crank 46. The crank 46 carries a crank-pin 47 which is articulated to a coupling member 49 which, in turn, is connected with a displacing device, e.g. a rollers-lever (not shown) which can be operated over a control cam from the machine drive. A weft monitor 51 is also disposed on the plate 4 which can be operated in known fashion from the machine drive. The monitor 51 includes a senser 53 mounted on an axle 52 so as to be pivotable toward the thread 1.

As shown in FIG. 4, the weft thread 1 is inserted by the shuttle 2 into the loom-shed in the direction indicated by the arrow 55 along a path given by the intersection of the lines A, B (FIGS. 1 and 2). The severing device is disposed between two thread-clamps 57, 58 which operate in accordance with the type of machine concerned and is situated in front of the fabric edge 56. The severing device operates in accordance with a predetermined program offer or take over, to sever the thread 1 or to transfer the thread to another organ of the machine.

After the passage of the shuttle 2, the crank 46 is pivoted out of the position shown in FIG. 1 into a position 46′, corresponding to the position shown in solid lines in FIG. 2. The gearwheel 44 thus becomes turned and the engaged rack 43 together with the support 35, becomes shifted vertically upward. The rollers 36, 37, 38 by way of their dot-dash middle position 36′, 37′, 38′ reach the position shown in solid lines in FIG. 2. Consequently, the levers 7, 8 are pivoted out of their position shown in FIG. 1 into their position of FIG. 2, in which the severing element 19 and the anvil element 25 encounter one another in the region of the line A, and sever the thread 1.

While the levers 7, 8 are making their closure movement, the senser 53 of the thread monitor 51 becomes pivoted into the position 53′, which corresponds to the position 7′, 8′ of the levers 7, 8. The thread 1 is then set against the flanks of the guide-arm 13 or of the guide-tooth 32 and deviated into the position 1′ in order to check for intactness.

While the two levers 7, 8 complete their closing movement, the senser 53 is, in the case of an unimpaired thread held taut by a known contrivance, swung back again out of the position 53′ until — still prior to the meeting of the two severing elements 19, 25 — a position is assumed outside the path of the thread as shown in solid lines in FIGS. 1 and 2.

During operation, the thread 1 becomes centered via the approaching elements 19, 25 in the diminishing opening formed by the flanks of the guide-arms 13, 14 and the guide teeth 32 and finally becomes severed when the cutting edge 20 of the severing element 19 encounters the anvil surface 29. The cam surfaces 7*a*, 7*b* and 8*a*, 8*b*, cooperating with the rollers 36, 37, 38, are proportioned to one another so that the lever 8 moves in advance of the lever 7. For example, if in accordance with FIG. 1, the levers position is 7′, 8′, then the spacing of the anvil surface 29′ from the line A is approximately half that of the corresponding cutting edge 20′. The anvil surface 29 therefore has already reached the end position given by line A ahead of the cutting edge 20 and the thread 1 is centered exactly for the ensuing severing operation, or for a superposed or a subsequent operation.

The cam surface 7*b* which cooperates with the roller 37 runs, in the region corresponding to the closed position of the lever 7, into a relatively flat continuous course. In this way the severing element 19 becomes laid practically shockfree against the anvil surface 29 and the thread 1. The further course of the cam surface 7*b* is made such that, in the operative position shown in FIG. 2, in which the sharp edge 20 bears against the thread 1 and a part of the anvil surface 29, the cam surface 7*b* is at a spacing C from the roller 37. Thus, the lever 7 and consequently the cutting edge 20 which is already in contact with the thread 1 becomes pressed against the other lever 8 and the anvil surface 39 respectively under the action of the strong spring 39. The thread 1 is then severed while the springs 39, 40 absorb the force of impact of the elements 7, 8 on each other.

By pivoting the crank 46 into the position shown in FIG. 1, the levers 7, 8 are pivoted back into the position corresponding to that in which they clear the path for a new insertion of a weft.

The severing element 19 is set loosely on the pin 18 and each time the element 19 encounters the anvil surface 29, the element 19 is able to set itself automatically into the position in which the cutting edge 20 lies for practically its entire length in a substantially straight line. Under the action of the spring 21, the severing element 19 is held, through friction-coupling, elastically in this position. For the purpose of changing the cutting edges, the severing element 19 can be turned 90° about the pin 18 to bring a new cutting edge 20 into operative position. This new edge then adjusts itself automatically in the way already described. A fine adjustment is not needed. When all four edges have become worn, the severing element 19 may be removed from the pin 18 by lifting the end of the spring 21 off the pin 18, and the element 19 may be replaced by a new one.

Figure 5:
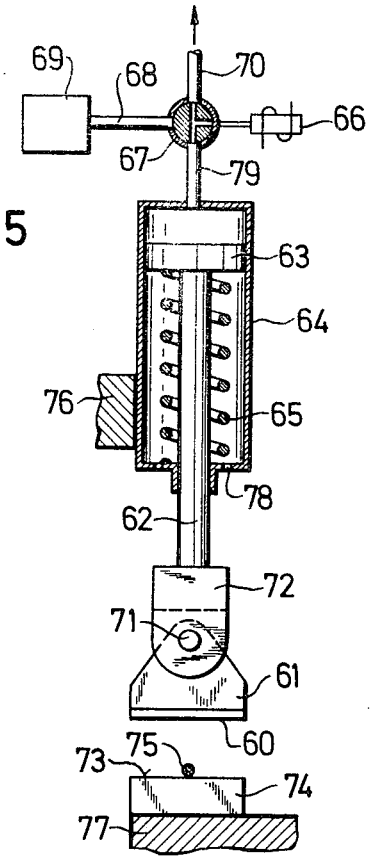
FIGS. 5 and 6 illustrate other severing devices, each in a modified form of construction.

Referring to FIG. 5, the severing device can also be constructed in a simpler manner. For example, the device has a chisel-like severing element 61 hinged to a piston-rod 62 of a pressure-applying piston 63 which is piloted in a pressure cylinder 64, and subjected to the action of a spring 65 applying pressure. The pressure cylinder 64 is fastened to a part 76 of the machine frame and by means of a pressure line 79 is connected to a change-over valve 67 which can, via an electric relay 66, be switched between two positions. The valve 67 on the one hand is connected to a power storage means in the form of a compressed air tank 69 and on the other hand to an exhaust line 70. The severing element 61 is set loosely to pivot on an axle 71, which is mounted in two side-bars 72 of the piston rod 62. In the operative position shown in FIG. 5, the severing element 61 is held at a spacing above an anvil element 74 disposed in a part 77 of the machine frame. The anvil element 74, as above, has a supporting surface 73 over which a thread 75 can run.

The severing of the thread 75 is accomplished each time through the relay 66 being supplied with current through a switching device (not shown) operated from a machine drive or perhaps by hand, with the valve 67 being brought out of the position shown in FIG. 5 into a position to connect the pressure lines 68 and 79. Thus, the piston 63 becomes pressed downward against the action of the pressure spring 65, with simultaneous venting of the lower space of the cylinder through openings 78, until the severing element 61 strikes the thread 75 and anvil surface 73, and the thread 75 becomes severed. The cutting edge 60 as above adjusts itself automatically.

To lift the severing element 61, the relay 66 is supplied anew with current and the valve 69 is set back into the position shown in FIG. 5. The valve 67 then connects the pressure line 79 with the blow-off line 70. The pressure piston 63 becomes raised through the unstressing of the pressure spring 65 and the upper cylinder space becomes vented through the blow-off line 70.

Figure 6:
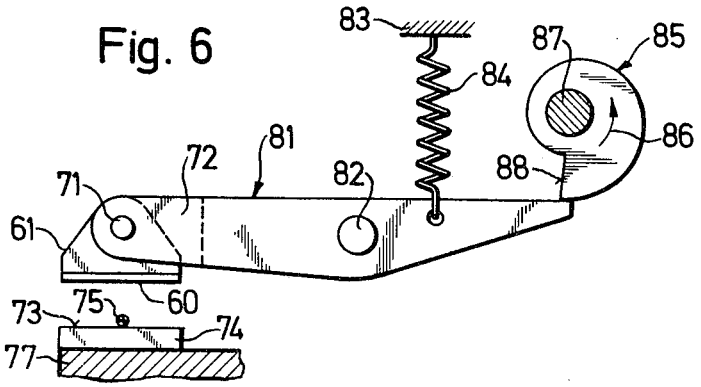

Referring to FIG. 6, the severing element 61 may alternatively be hinged to one end of a two-armed lever 81, mounted to pivot on a pivot-pin 82. The other end of the lever 81 is biased under the action of a tension-spring 84, fastened to a part 83 of the machine frame, against the cam surface of a control cam 85. This cam 85 is set on a shaft 87 which can be driven by a machine drive in the direction indicated by the arrow 86. The cam surface of the cam 85 has a step 88, through which, with the cam 85 turning, the lever end acted on by the tension spring 84 triggers an abrupt counter-clockwise pivoting. The severing element 61 accordingly moves toward the thread 75 and anvil surface 73 and hits the surface abruptly. With this construction, the loosely mounted severing element 61 adjusts itself automatically each time to the cooperating anvil surface.

Various forms of construction of the invention are possible. Thus, for example the movable element of the severing device may be operated by a magnet, or perhaps under the action of its own weight, so as to be moved toward the other element. Of course, there may also be a construction with a movable anvil element and an immovable chisel-like severing element, or one that makes only adjusting movements. It is also possible to have a plurality of operative edges or surfaces for the severing element as well as for the anvil element.

Severing devices in accordance with the invention may be used on practically all machines with which a thread, band or wire material has to be cut through.

What is claimed is:

1. A thread severing device for a loom having a drive comprising an anvil element having a thread supporting surface;

a chisel-like severing element having a cutting edge for abutting against said supporting surface;

a holder supporting at least one of said elements relative to the other of said elements, said one element being pivotally mounted on said holder on an axis parallel to a direction of thread travel across said supporting surface, said holder being adapted for actuation off said drive; and a power storage means connected to at least said one element to absorb a force of impact of said elements on each other during severing of a thread therebetween.

2. A thread severing device as set forth in claim 1 wherein said one element is pivotally mounted on said holder in a selective one of a plurality of positions.

3. A thread severing device as set forth in claim 2 further comprising holding means for securing said one element to said holder in said one position under a variable force.

4. A thread severing device as set forth in claim 3 wherein said holding means is a spring mounted on said holder.

5. A thread severing device as set forth in claim 3 wherein said holding means is a screw threadably mounted in said holder.

6. A thread severing device as set forth in claim 1 which further includes a cam mounted on a fixed axis and said holder includes a cam surface biased toward said cam to engage said cam when said cutting edge and said supporting surface are spaced apart and to be spaced from said cam when said cutting edge and said supporting surface initially abut each other.

7. A thread severing device as set forth in claim 1 wherein said severing element has at least two cutting edges for selective mounting in facing relation to said supporting surface.

8. A thread severing device as set forth in claim 1 wherein said severing element has at least two supporting surfaces for selective mounting in facing relation to said cutting edge.

9. A thread severing device as set forth in claim 1 wherein said anvil element has guide teeth on two opposite sides of said supporting surface, said teeth projecting beyond said supporting surface toward said severing element to guide a thread to said supporting surface.

10. A thread severing device as set forth in claim 9 wherein said teeth each have a flank forming an obtuse angle with said supporting surface.

11. A thread severing device comprising an anvil element having a thread supporting surface;

a chisel-like severing element having a cutting edge for abutting against said supporting surface to sever a thread thereon;

means supporting said elements for relative movement towards each other to bring said cutting edge into abutment with said supporting surface, at least one of said elements being pivotally mounted on said means whereby at least one of said cutting edge and supporting surface is pivotally mounted relative to the other; and a power storage means connected to at least one of said elements to absorb a force of impact of said cutting edge on said supporting surface.

12. A thread severing device as set forth in claim 11 wherein said power storage means is a spring.

13. A thread severing device as set forth in claim 11 wherein said power storage means is a compressed air tank pneumatically connected to said one element.

14. A thread severing device as set forth in claim 11 wherein said supporting means includes a pair of pivotally mounted levers, each said lever having a respective one of said elements mounted thereon, and means for pivoting said levers relative to each other.

15. A thread severing device as set forth in claim 14 wherein said anvil element is pivotally mounted on a respective lever and said supporting means includes a spring biased against said anvil element to hold said anvil element against said respective lever under an adjustable force.

16. A thread severing device as set forth in claim 14 wherein said severing element is pivotally mounted on a respective lever and said supporting means includes a screw holding said severing element on said lever under an adjustable force.

17. A thread severing device comprising an anvil element having a thread supporting surface;

a chisel-like severing element having a cutting edge for abutting against said supporting surface to sever a thread thereon;

means supporting said elements for relative movement towards each other to bring said cutting edge into abutment with said supporting surface, at least one of said elements being pivotally mounted on said means to freely adjust to the other of said elements; and a means for elastically holding said elements in position during contact of said cutting edge on said supporting surface.

18. A thread severing device as set forth in claim 17 wherein said latter means is a spring.

19. A thread severing device as set forth in claim 17 wherein said latter means is a compressed air tank pneumatically connected to said one element.

* * * * *

UNITED STATES PATENT AND TRADEMARK OFFICE

CERTIFICATE OF CORRECTION

PATENT NO. : 3,951,179

DATED : April 20, 1976

INVENTOR(S) : Erwin Pfarrwaller

It is certified that error appears in the above-identified patent and that said Letters Patent are hereby corrected as shown below:

Column 7, line 20 (claim 8), "severing" should be --anvil--.

Signed and Sealed this

Twentieth Day of July 1976

[SEAL]

*Attest:*

RUTH C. MASON
*Attesting Officer*

C. MARSHALL DANN
*Commissioner of Patents and Trademarks*